US005798603A

United States Patent [19]

Tsuruoka et al.

[11] Patent Number: 5,798,603

[45] Date of Patent: Aug. 25, 1998

[54] CATHODE RAY TUBE HAVING IMPROVED BEAM CONVERGENCE

[75] Inventors: Atsushi Tsuruoka, Mobara; Masayoshi Misono, Chousei-gun, both of Japan

[73] Assignees: Hitachi, Ltd., Tokyo; Hitachi Electronic Devices Co., Ltd., Chiba-ken, both of Japan

[21] Appl. No.: 619,893

[22] Filed: Mar. 8, 1996

[30] Foreign Application Priority Data

Mar. 13, 1995 [JP] Japan ..... 7-052255

[51] Int. Cl.[6] ..... H01J 29/50

[52] U.S. Cl. ..... 313/412; 313/414; 313/449; 313/413

[58] Field of Search ..... 313/412, 413, 313/414, 449

[56] References Cited

U.S. PATENT DOCUMENTS

| | | | |
|---|---|---|---|
| 4,962,333 | 10/1990 | Sluyterman | 313/413 X |
| 5,113,112 | 5/1992 | Shimoma et al. | 313/413 X |
| 5,262,702 | 11/1993 | Shimoma et al. | 313/414 X |
| 5,585,690 | 12/1996 | Misono | 313/413 |
| 5,625,252 | 4/1997 | Tsuzurahara et al. | 313/414 |
| 5,656,884 | 8/1997 | Lee | 313/412 |
| 5,677,591 | 10/1997 | Toujou et al. | 313/414 |

*Primary Examiner*—Hezron E. Williams
*Assistant Examiner*—Daniel S. Larkin
*Attorney, Agent, or Firm*—Antonelli, Terry, Stout & Kraus, LLP

[57] ABSTRACT

A cathode ray tube includes an evacuated envelope having a panel portion carrying a phosphor screen, a neck portion housing an electron gun and a funnel portion for connecting the panel portion and neck portion, the electron gun housed in the neck portion and a deflection device mounted in a transition region between the funnel portion and neck portion. The electron gun is provided with an electrode having a single opening common to the three electron beams and having correction electrodes disposed in vicinities of both edges of the single opening in the inline direction and extending substantially parallel with a cathode ray tube axis into a region downstream of an end surface of an anode electrode forming a main lens on a cathode side thereof and provided with electric field produced by the main lens, and the electrode having the single opening is electrically connected to the anode electrode.

23 Claims, 8 Drawing Sheets

CATHODE RAY TUBE HAVING IMPROVED BEAM CONVERGENCE

BACKGROUND OF THE INVENTION

The present invention relates to a cathode ray tube and, more particularly, to a cathode ray tube having an electron gun for providing an excellent color image with an improved beam convergence over the entire phosphor screen.

A color cathode ray tube of the inline plural electron beam type is widely used as image displaying means in a TV receiver or a monitor terminal.

FIG. 9 is a sectional view for explaining a construction of a color cathode ray tube of a shadow mask type as an example of the cathode ray tube. Reference numeral 1 denotes a panel portion serving as a display screen; 2 a neck portion housing an electron gun; 3 a funnel portion for connecting the panel portion and the neck portion; 4 a phosphor screen formed inside the panel portion; 5 a shadow mask; 6 a mask frame for holding the shadow mask; 7 a magnetic shield for shielding external magnetic fields; 8 a suspension spring; 9 an inline electron gun; and 10 a deflection device; 11 convergence/purity magnets. Reference character Bc denotes a center electron beam; and Bs side electron beams.

In the color cathode ray tube of this kind shown in FIG. 9, an evacuated envelope is comprised of the panel portion 1 having the phosphor screen 4 on its inner surface, the neck portion 2 housing the electron gun 9, and the funnel portion 3 connecting the panel portion and neck portion.

The electron gun housed in the neck portion has a plurality of electrodes such as a cathode, a control grid electrode, a focus electrode and an anode electrode opposite the focus electrode: The focus and anode electrodes form a main lens which emits a plurality of inline electron beams toward the phosphor screen 4.

The deflection device 10 mounted in a transition region between the funnel portion and the neck portion of the evacuated envelope deflects three electron beams emitted from the electron gun 9 in both the horizontal and vertical directions on the phosphor screen 4. The electron beams are subjected to a color selection by the shadow mask 5 and impinge on the phosphor screen 4, thereby forming a color image.

The shadow mask 5 is fixedly welded to the mask frame 6 and is held in the panel in predetermined spaced relationship to the phosphor screen 4 with the suspension springs 8 fixed to the outer periphery of the mask frame 6 being engaged with panel pins embedded in an inner wall of the panel 1.

FIG. 10 is a side view for explaining an example of the electron gun housed in the neck portion of the color cathode ray tube. Reference character K denotes a cathode, reference numeral 91 indicates a first grid electrode; 92 a second grid electrode; 93 a third grid electrode; 94 a fourth grid electrode; 95 a fifth grid electrode (a focus electrode); 96 a sixth grid. electrode (an anode electrode); 97 a cylinder electrode (a shield cup); 98 a bead glass; and 99 a stem.

In FIG. 10, the first to fourth grid electrodes 91 to 94 control and prefocus the electron beams and the fifth grid electrode 95 serving as a focus electrode and the sixth grid electrode 96 serving as an anode form a main lens.

The cylinder electrode 97, the so-called shield cup, is connected to the anode electrode (sixth grid electrode) 96 and has contact springs fixed to it for centering the electron gun within the neck portion and a getter fixed to it.

In addition to the electron gun of the above type, there are an electron gun of a type having a cathode, a first grid electrode, a second grid electrode, a third electrode (a shield cup ), a fourth grid electrode and a cylinder electrode and forming a main lens between the third and fourth electrodes, and electron guns of other various types.

FIG. 11 is a sectional view of the main portion for explaining a construction example of electrodes in the main lens section in the conventional electron gun.

In FIG. 11, the cylinder electrode 97 is attached to the anode electrode 96 and is formed with three beam apertures 97*s*, 97*m* and 97*s* in its bottom on the anode electrode 96 side. Three beam apertures 96*a*, 96*b*, and 96*c* are provided on the focus electrode side 95 of the anode electrode 96. Three beam apertures 95*a*, 95*b*, and 95*c* are also provided on the anode electrode 96 side of the focus electrode 95. The main lens is formed in the facing portions of the focus electrode 95 and the anode electrode 96. In the electron gun of this kind, the center axes of the beam apertures 96*a* and 96*c* formed in the anode electrode 96 are offset outwardly by an amount of d with respect to lines spaced a beam spacing S from the tube axis in the inline direction of the beams, along which lines the side electron beams enter the main lens, to achieve the so-called static convergence, that is, to converge three electron beams Bs, Bc, and Bs at the center of the phosphor screen at zero deflection.

With such a construction, the two side electron beams Bs's are bent toward the center electron beam Bc and the three electron beams are converged at a point on the phosphor screen.

FIG. 12 is a sectional view of the main section for explaining another electrode construction example of the main lens section in the conventional electron gun.

In the electron gun of this type, the focus electrode 95 and the anode electrode 96 have a single opening for passing the three electron beams formed in each of their facing ends and internal electrodes 95-1 and 96-1 of a plate shape disposed at positions therein set back from the single openings respectively.

Apertures 97*s*, 97*m*, and 97*s* are formed for passing the three electron beams respectively in the bottom of the cylinder electrode 97 (on the anode electrode 96 side).

In the focus electrode 95, the side electron beams Bs and Bs pass a space between the internal electrode 95-1 and the inner wall of the focus electrode and the center electron beam Bc passes through the central aperture of the internal electrode 95-1 and they enter the main lens.

After the three electron beams have passed the main lens, in the anode electrode 96, the side electron beams Bs and Bs pass a space between the internal electrode 96-1 and the inner wall of the anode electrode and the center electron beam Bc passes through the central aperture of the internal electrode 96-1. The three electron beams subsequently pass through the apertures 97*s*, 97*m*, and 97*s* in the cylinder electrode 97 respectively and are directed toward the phosphor screen.

The resolution of the cathode ray tube of this kind depends on the size and shape of a beam spot formed on the phosphor screen, so that it is important to make the beam spot as small as possible in order to obtain high resolution.

In the electron gun of the type described in FIG. 11, in order to achieve the static convergence or to converge three electron beams at the center of the screen at zero deflection, the center axis of the side electron beam aperture in the anode electrode 96 is offset outwardly in the inline direction of the beams by an amount of d with respect to the center axis of the corresponding side electron beam aperture in the focus electrode 95.

In the electron gun of the type described in FIG. 12, the two side electron beams Bs's are deflected toward the center electron beam Bc to overlap on the center electron beam on the phosphor screen at zero deflection by adjusting the amount of setting back the internal electrodes 95-1 and 96-1 within the focus electrode 95 and the anode electrode 96 of a main lens, respectively, from the respective facing-ends of the focus and anode electrodes 95 and 96.

In electron guns of these kinds, as means for obtaining a satisfactory reproduced image from the center to the periphery of the phosphor screen, for example, Japanese Patent Publication 51-18866 discloses disposition of an astigmatic lens in a region between second and third grid electrodes, Japanese Patent Application Laid-Open No. SHO 51-64368 discloses employment of vertically elongated electron beam apertures in control grid and screen grid electrodes, and beam apertures of different shapes, or a smaller ratio of the vertical to the horizontal axes of an elliptical aperture for the center electron beam than those for the side electron beams, in a prefocus lens of an inline three-beam electron gun, and Japanese Patent Application Laid-Open No. SHO 60-81736 discloses employment of a non-axially-symmetric lens formed by slits at least in the third grid electrode on the cathode side in which the slit for the center electron beam is deeper in the electron gun axis direction than those for the side electron beams, for impacting the electron beams onto the phosphor screen in an inline electron gun.

SUMMARY OF THE INVENTION

Screen sizes of a color cathode ray tube vary with use and desired performance. Production of color cathode ray tubes incorporating a particular electron gun exclusively for a particular one of various screen sizes of color cathode ray tubes deteriorates mass productivity, and if a common electron gun can be incorporated into cathode ray tubes irrespective of the screen size, the mass productivity is improved.

If an electron gun designed for a small-sized color cathode ray tube (for example, of a screen diagonal of 15 inches) is incorporated into a large-sized tube (for example, of a screen diagonal of 21 inches) a phenomenon of overconvergence occurs in which three electron beams are converged at a point on the electron gun side before the phosphor screen, because of increase in the distance between the electron gun and the phosphor screen in the large-sized tube.

As means for solving the overconvergence problem, hitherto, a new main portion of the electron gun has been designed by modifying an outward offset distance of the center axes of side electron beam apertures in an anode electrode in the inline direction of the electron beams with respect to the center axes of side electron beam apertures in a focus electrode, or modifying distances of internal electrodes disposed in the focus and anode electrodes from their facing ends. That is, since a particular electron gun designed exclusively for a particular screen size is incorporated into color cathode ray tubes of the particular one of various screen sizes, conventional color cathode ray tubes lack mass productivity.

It is, therefore, an object of the invention to provide a cathode ray tube having an electron gun in which redesigning of the main section of the electron gun is unnecessary, and the main section of the electron gun can be used in common for different screen sizes by only modifying a correction electrode disposed outside of the main section of the electron gun even when the screen size is changed.

In order to accomplish the object, according to the invention, there is provided a cathode ray tube including: an evacuated envelope including a panel portion carrying a phosphor screen, a neck portion housing an electron gun, and a funnel portion for connecting the panel portion and the neck portion; the electron gun housed in the neck portion for emitting three electron beams in an inline manner; and a deflection device mounted in a transition region between the funnel portion and the neck portion of the evacuated envelope, wherein the electron gun is provided with an electrode having a single opening common to the three electron beams and having correction electrodes disposed in vicinities of both edges of the single opening in the inline direction and extending substantially parallel with a cathode ray tube axis into a region downstream of an end surface of an anode electrode forming a main lens on a cathode side thereof and provided with an electric field produced by the main lens, and the electrode having the single opening is electrically connected to the anode electrode.

DETAILED DESCRIPTION OF THE PREFERRED EMBODIMENTS

Hitherto, no consideration has been given to the relationship between an electron beam aperture in the so-called shield cup (cylinder electrode) and static convergence.

Figure 10:
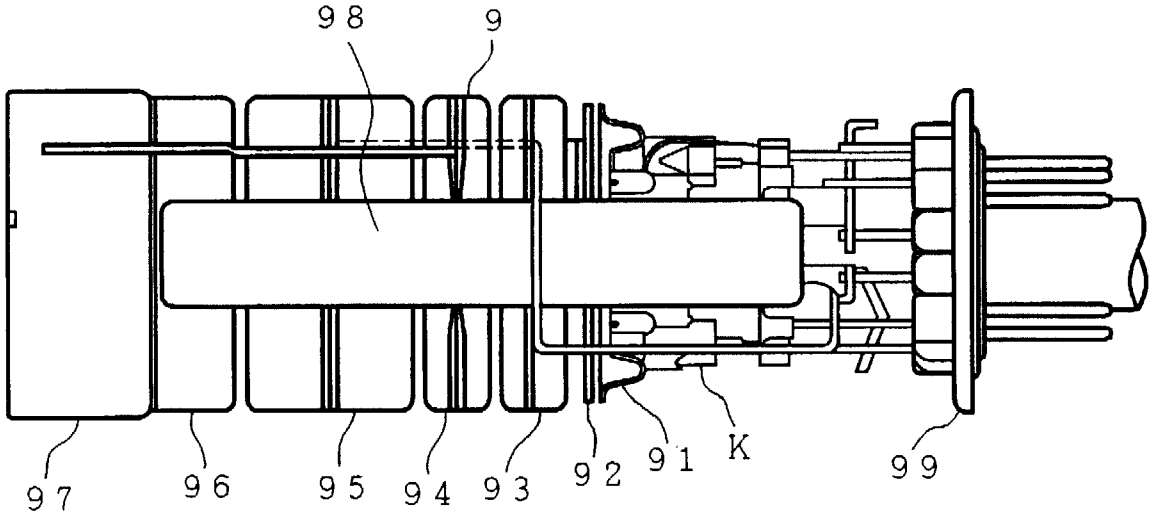
FIG. 10 (PRIOR ART)
FIG. 10 is a top view for explaining an example of an electron gun housed in a neck portion of the color cathode ray tube.
Figure 11:
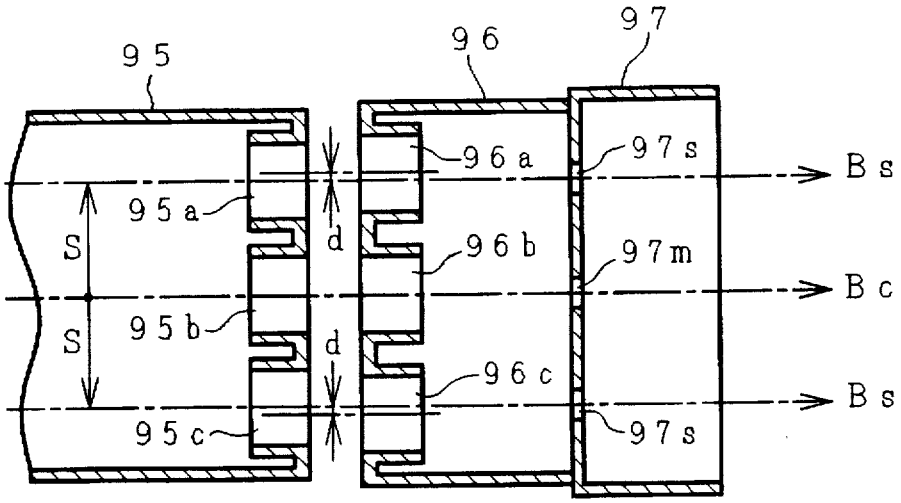
FIG. 11 (PRIOR ART)
FIG. 11 is a sectional view of a main portion for explaining an example of an electrode construction in a main lens section in a conventional electron gun.
Figure 12:
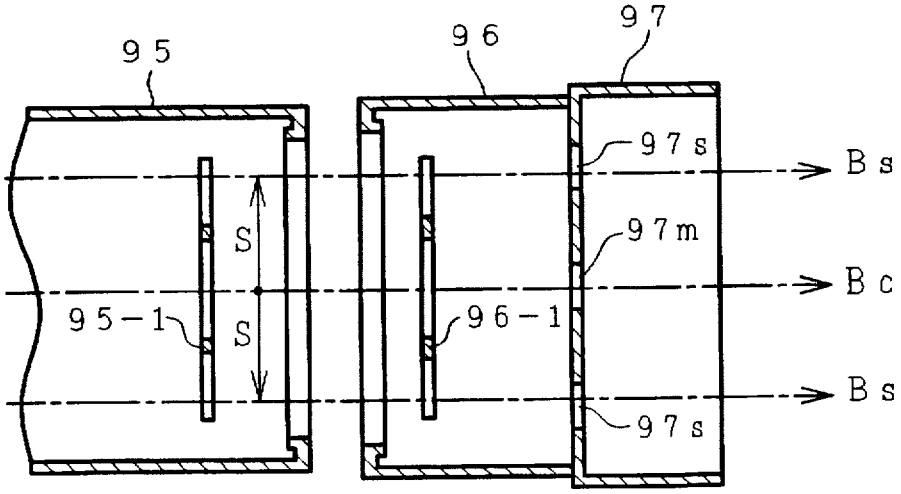
FIG. 12 (PRIOR ART)
FIG. 12 is a sectional view of a main portion for explaining another example of an electrode construction of the main lens section in the conventional electron gun.

In the electron gun shown in FIG. 10, an influence exerted on the electron beam in an electric field differs depending on a length of each electrode, an electron beam aperture, and the like. For example, the shape of the electron beam aperture in the first electrode 91 near the cathode K has an influence on a spot shape of the electron beam only in a small current region and the shape of the electron beam aperture in the second electrode 92 has an influence on a spot shape of the electron beam from the small current region to a large current region.

In the electron gun having a main lens formed between the fifth electrode 95 and the sixth electrode 96 with the sixth electrode 96 supplied with an anode voltage, shapes of the electron beam apertures in the fifth electrode 95 and sixth electrode 96 of the main lens exert a great influence upon the electron beam spot shape in the large current region, but a less influence on the electron beam spot shape in the small current region as compared in the large current region.

The axial length of the fourth electrode 94 in the electron gun exerts an influence on the magnitude of an optimum focus voltage and also exerts a remarkable influence on a difference between the optimum focus voltages in the small and large currents, but a change in the axial length of the fifth electrode 95 exerts an influence remarkably smaller than that of the fourth electrode 94.

In order to optimize respective characteristics of the electron beams, therefore, it is necessary to optimize the construction of the electrode which most effectively acts on the respective characteristics.

The diameter of the electron beam spot on the phosphor screen, depends on a spherical aberration of the main lens. The spherical aberration can be reduced by enlarging the aperture of the main lens.

If an aperture pitch of the shadow mask in a direction perpendicular to the beam scanning direction of the cathode ray tube is reduced or the density of the electron beam scanning lines is made high, an interference occurs between the electron beam and a geometric structure of the shadow mask especially in the small current region of the electron beam, and it is necessary to suppress a moire contrast.

Further, a single circular, elliptic, oblong, oval, or rectangular electron beam opening for passing the three electron beams in common is formed in the bottom of the cylinder electrode 97. The electron beam opening exerts an influence on the electron beams which have passed the main lens.

Embodiments of the invention will now be described in detail hereinbelow with reference to the drawings.

Figure 1:
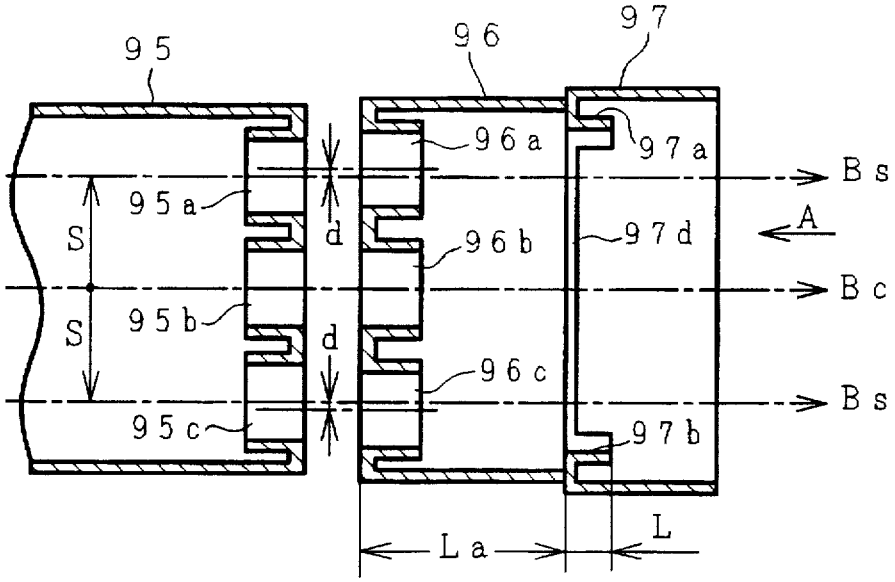
FIG. 1 is a sectional view of the main portion of an electron gun for explaining a first embodiment of a cathode ray tube according to the invention.
Figure 2:
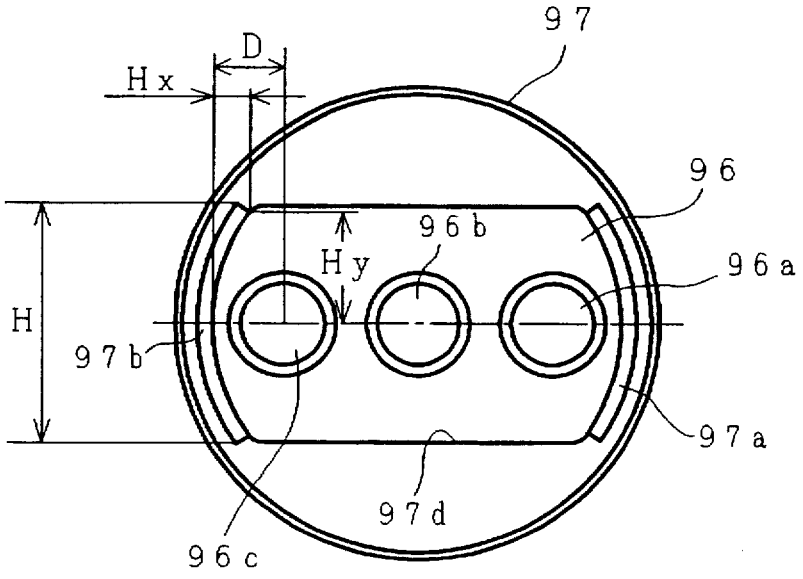
FIG. 2 is an elevation viewed in the direction of the arrow A of FIG. 1.

FIG. 1 is a cross section of a main portion of an electron gun for explaining a first embodiment of the cathode ray tube according to the invention. FIG. 2 is an elevation viewed in the direction of the arrow A in FIG. 1. Reference numeral 95 denotes the focus electrode to which a voltage of 22–33% of the anode voltage is ordinarily applied; 95*a*, 95*b*, and 95*c* the electron beam apertures formed on the anode side of the focus electrode 95; 96 the anode electrode to which a voltage of about 25–30 kV is ordinarily applied; 96*a*, 96*b*, and 96*c* the electron beam apertures formed on the focus electrode side of the anode electrode 96; 97 the shield cup comprised of a cylinder electrode; and 97*d* the single opening formed in the bottom of the shield cup 97. Reference character Bc denotes the center electron beam; Bs the side electron beam; S a spacing between the electron beams which enter the main lens formed between the facing ends of the focus electrode 95 and anode electrode 96; and d an offset distance of the side electron beam apertures 96*a* and 96*c* formed in the bottom of the anode electrode 96.

In case of an electron gun of a bipotential type incorporated into a 29 mm diameter neck, an axial length La of the anode electrode 96 is ordinarily equal to or less than 7 mm.

In FIG. 1, the electron beams Bs and Bc enter the main lens with the spacing S therebetween and are subjected to intended focusing and enter the single opening formed in the bottom of the shield cup 97. Each of the focus electrode 95 and the anode electrode 96 is a cylinder electrode having an oval, oblong, or elliptic cross section with its major axis in the inline direction of electron beams or a generally rectangular cross section and the diameter is enlarged as much as possible, thereby enlarging an effective diameter of the main lens.

The shield cup 97 is cylindrical as shown in FIG. 2 and there are provided correction electrodes 97*a* and 97*b* which are folded back in parallel with the passing direction of the electron beams on both the edges in the inline direction of the single opening 97*d* formed in the bottom of the shield cup 97.

Each of the correction electrodes 97*a* and 97*b* is extended from the bottom of the shield cup 97 toward the phosphor screen, is arcuate in cross section so as to partially surround the side electron beam, and produces a deflection electric field for deflecting the side electron beam in the direction opposite to the center electron beam, and acts so as to achieve the static convergence.

The cross section of the correction electrodes 97*a* and 97*b* is not limited to an arc as mentioned above. For example, it can be planar. A dimension H in the direction perpendicular to the inline direction of the electron beams and a spacing D from the side electron beam are designed in accordance with the desired focus characteristics of the electron gun employed and the screen size of the cathode ray tube. In FIG. 2, it is preferable that dimensions Hx and Hy indicative of the tip positions of the correction electrodes 97*a* and 97*b* satisfy D>Hx, Hy>Hx. These conditions suppress deflection components in the vertical direction produced by the correction electrodes 97*a* and 97*b*. As shown, the tips of the correction electrodes 97*a* and 97*b* do not extend in a direction toward the tube axis beyond a plane containing the tube axis and extending perpendicular to the inline direction. That is, the correction electrodes 97*a* and 97*b* are only provided in the vicinity of the edges of the opening which extend substantially transverse to the inline direction. The relation also applies to the example of FIG. 5 which will be described hereinafter.

The diameter in the vertical direction of the opening 97*d* in the shield cup 97 is ordinarily set to 3 mm or larger, thereby preventing the shield cup 97 from being heated by an impingement of the excessive amount of the electron beam thereon.

The convergence correction amount is controlled by a length L in the extending direction of the correction electrodes 97*a* and 97*b*. When the length L is reduced, the deflection amount of the side electron beams toward the center electron beam increases, and when the length L is increased, the deflection amount decreases.

In case of the bipotential type electron gun, the length L does not need to exceed 2 mm. Even when it exceeds 2 mm, the amount of beam deflection by the correction electrodes 97*a* and 97*b* saturates. This applies to third and fifth embodiments which will be described hereinafter.

With this, the proper static convergence is achieved and the cathode ray tube capable of reproducing an image of high resolution can be obtained.

Figure 3:
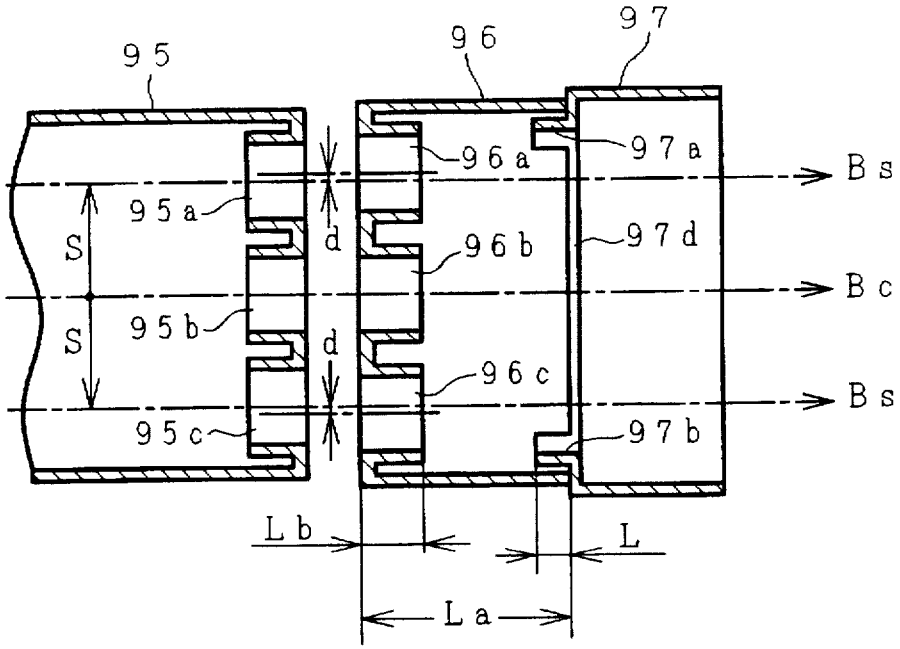
FIG. 3 is a sectional view of the main portion of an electron gun for explaining a second embodiment of the cathode ray tube according to the invention.

FIG. 3 is a sectional view of the main portion of an electron gun for explaining a second embodiment of the cathode ray tube according to the invention wherein the same reference numerals as utilized in FIG. 1 designate corresponding portions in FIG. 3.

The second embodiment is similar to the first embodiment except that each of the correction electrodes 97*a* and 97*b* formed in the bottom of the shield cup 97 extends toward the anode electrode 96.

That is, the correction electrodes 97*a* and 97*b* are drawn from and extend from the bottom of the shield cup 97 into the anode electrode 96 and produce a static-convergence correction electric field for the side electron beams. In the first and second embodiments, the correction electrodes 97*a* and 97*b* can be formed separately from the shield cup 97 and fixed to its bottom by means of welding or the like.

The deflection amount by the length L in the extending direction of the correction electrodes 97*a* and 97*b* is also adjusted in the same way as in the foregoing embodiment.

Thus, the proper static convergence can be achieved and the cathode ray tube capable of reproducing an image of high resolution can be obtained.

In case of an electron gun incorporated into the cathode ray tube of a 29 mm diameter neck, an axial length La of the anode electrode 96 is ordinarily equal to or less than 7 mm. A length Lb of the cylinder portion surrounding each of the electron beam apertures 96*a*, 96*b*, and 96*c* is equal to or less than 1 mm. A length L of each of the correction electrodes 97*a* and 97*b* is equal to or less than 6 mm. This relationship also applies to the fourth and sixth embodiments which will be described hereinafter.

Figure 4:
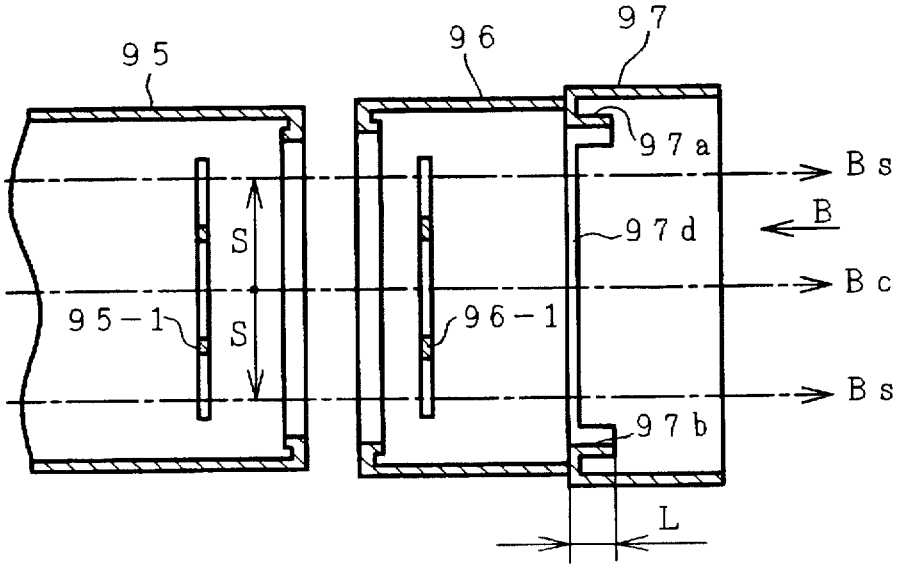
FIG. 4 is a sectional view of the main portion of an electron gun for explaining a third embodiment of the cathode ray tube according to the invention.
Figure 5:
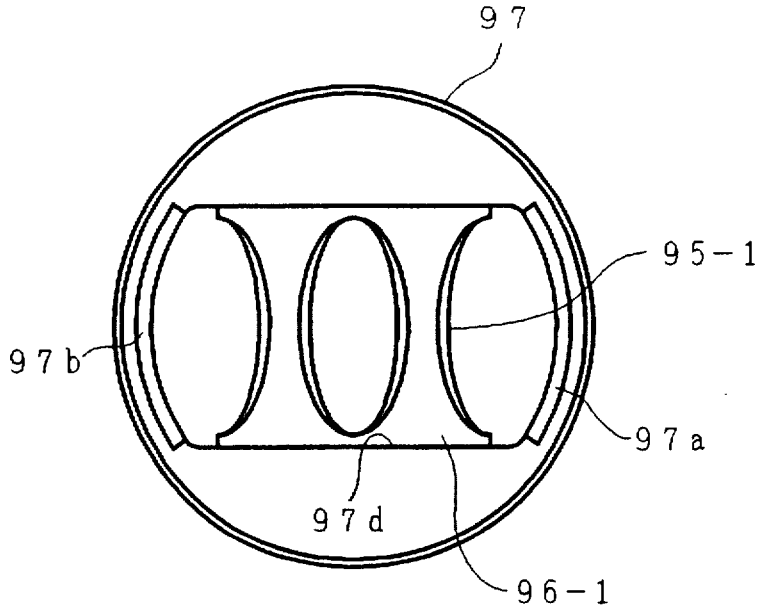
FIG. 5 is an elevation viewed in the direction of the arrow B of FIG. 4.

FIG. 4 is a cross section of the main portion of an electron gun for explaining a third embodiment of the cathode ray tube according to the invention. FIG. 5 is a front view viewed in the direction of the arrow B in FIG. 4. Reference numeral 95-1 denotes an internal electrode disposed in the focus electrode 95 and 96-1 indicates an internal electrode disposed in the anode electrode 96. The same reference numerals as utilized in FIG. 3 designate corresponding portions in FIG. 4.

In the third embodiment, as shown in FIG. 4, the invention is applied to an electron gun of a type in which a single opening is provided in a facing end of each of the focus electrode 95 and the anode electrode 96 and the internal electrodes 95-1 and 96-1 are respectively disposed at positions set back from the respective facing end.

As shown in FIG. 5, each of the internal electrodes 95-1 and 96-1 has a vertically-elongated opening for passing the center electron beam Bc. The side electron beams pass spaces between the inner walls of the focus electrode 95 and anode electrode 96 and the edges in the beam inline direction of the internal electrodes 95-1 and 96-1 and enter the shield cup 97.

The shield cup 97 has the single opening 97*d* for passing the three electron beams Bs, Bc, and Bs and the correction electrodes 97*a* and 97*b* drawn integrally from the shied cup in parallel with the passing direction of the electron beam are disposed at both edges of the single opening 97*d* in the inline direction of the electron beams.

Each of the correction electrodes 97*a* and 97*b* extendes from the bottom of the shield cup 97 toward the phosphor screen and is arcuate in cross section so as to partially surround the side electron beam, and produces a deflection electric field for deflecting the side electron beam in the direction opposite to the center electron beam to achieve the static convergence.

The cross section of the correction electrodes 97*a* and 97*b* is not limited to an arc. For example, it can be also planar. The height H in the direction perpendicular to the inline direction of the electron beams and the spacing D from the side electron beam are designed in accordance with the focus characteristics of the electron gun employed and the screen size of the cathode ray tube. The correction electrodes 97*a* and 97*b* can be also formed separately from the shield cup 97 and fixed to the bottom by means of welding or the like.

The amount of the convergence correction is controlled by the length L in the extending direction of the correction electrodes 97*a* and 97*b*. If the length L is increased, the deflection amount of the. side electron beam toward the center electron beam decreases, and if the length L is reduced, the deflection amount increases.

Thus, the static convergence is adjusted to be proper and the cathode ray tube capable of reproducing an image of high resolution can be obtained.

As already described in the first embodiment, the length L does not need to exceed 2 mm.

Figure 6:
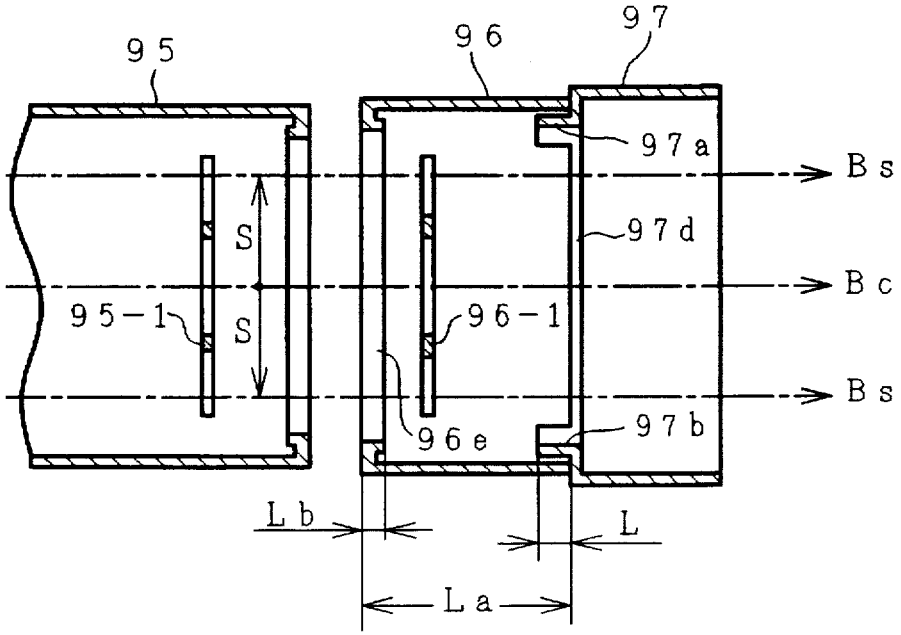
FIG. 6 is a sectional view of the main portion of an electron gun for explaining a fourth embodiment of the cathode ray tube according to the invention.

FIG. 6 is a sectional view of the main portion of an electron gun for explaining a fourth embodiment of the cathode ray tube according to the invention. The same reference numerals as utilized in FIG. 4 designate corresponding portions in FIG. 6.

The fourth embodiment is similar to the third embodiment except that each of the correction electrodes 97*a* and 97*b* formed in the bottom of the shield cup 97 extends toward the anode electrode 96.

That is, the correction electrodes 97*a* and 97*b* are drawn integrally from the bottom of the shield cup 97 and extend into the anode electrode 96 to produce the static convergence correction electric field for the side electron beams. In a manner similar to the foregoing embodiments, the correction electrodes 97*a* and 97*b* can be formed separately from the shield cup 97 and fixed to the bottom by means of welding or the like.

The adjustment of the deflection amount by the length L in the extending direction of the correction electrodes 97*a* and 97*b* is also similar to that in the foregoing embodiments.

Thus, the proper static convergence is achieved and the cathode ray tube capable of reproducing an image of high resolution can be obtained.

In case of the electron gun incorporated into the cathode ray tube of a 29 mm diameter neck, the axial length La of the anode electrode 96 is ordinarily equal to or less than 7 mm. The length Lb of the cylinder portion surrounding an electron beam aperture 96*e* is equal to or less than 1 mm. It is preferable that the tips on the cathode side of the correction electrodes 97*a* and 97*b* are on the phosphor screen side of the internal electrode 96-1 in the axial direction.

Figure 7:
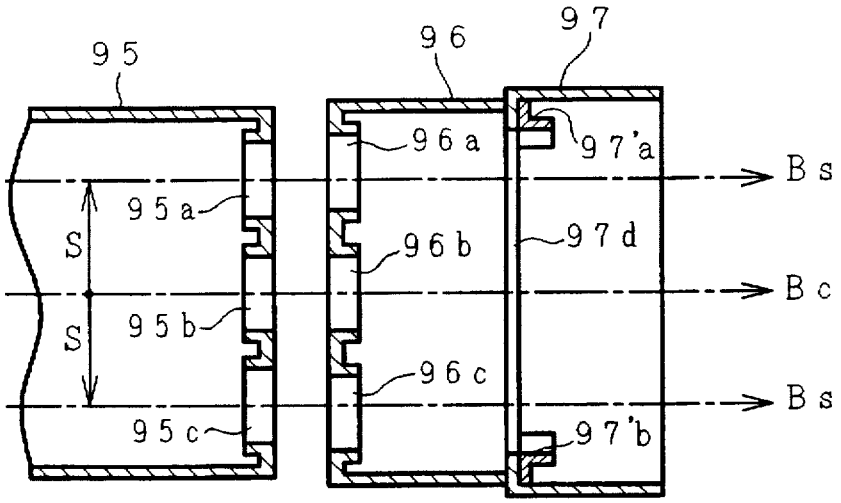
FIG. 7 is a sectional view of the main portion of an electron gun for explaining a fifth embodiment of the cathode ray tube according to the invention.

FIG. 7 is a sectional view of the main portion of an electron gun for explaining a fifth embodiment of the cathode ray tube according to the invention. The correction electrodes 97*a* and 97*b* formed in the shield cup 97 described in FIG. 1 are formed separately from the shield cup 97 and are fixed to the bottom of the shield cup 97 by means of welding or the like.

In a manner similar to the above, the correction electrodes 97*a* and 97*b* in the electron gun described in FIG. 3 can be also formed separately from the shield cup 97.

Figure 8:
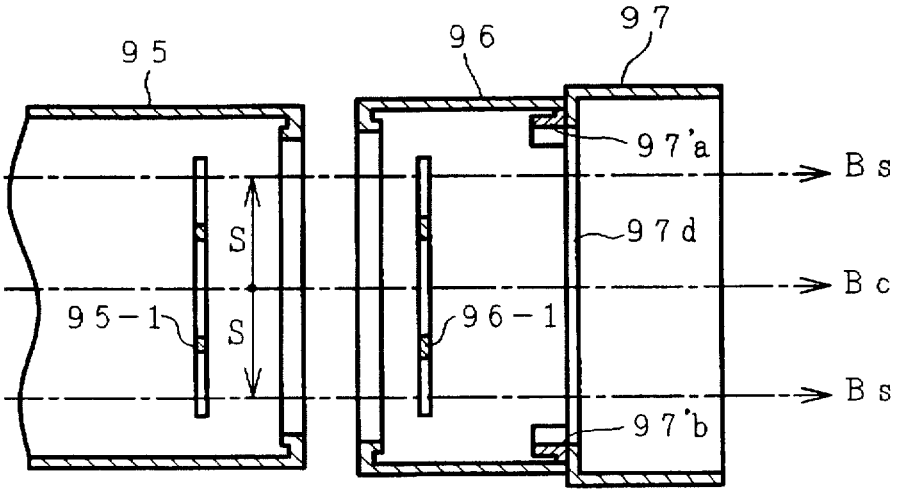
FIG. 8 is a sectional view of the main portion of an electron gun for explaining a sixth embodiment of the cathode ray tube according to the invention.
Figure 9:
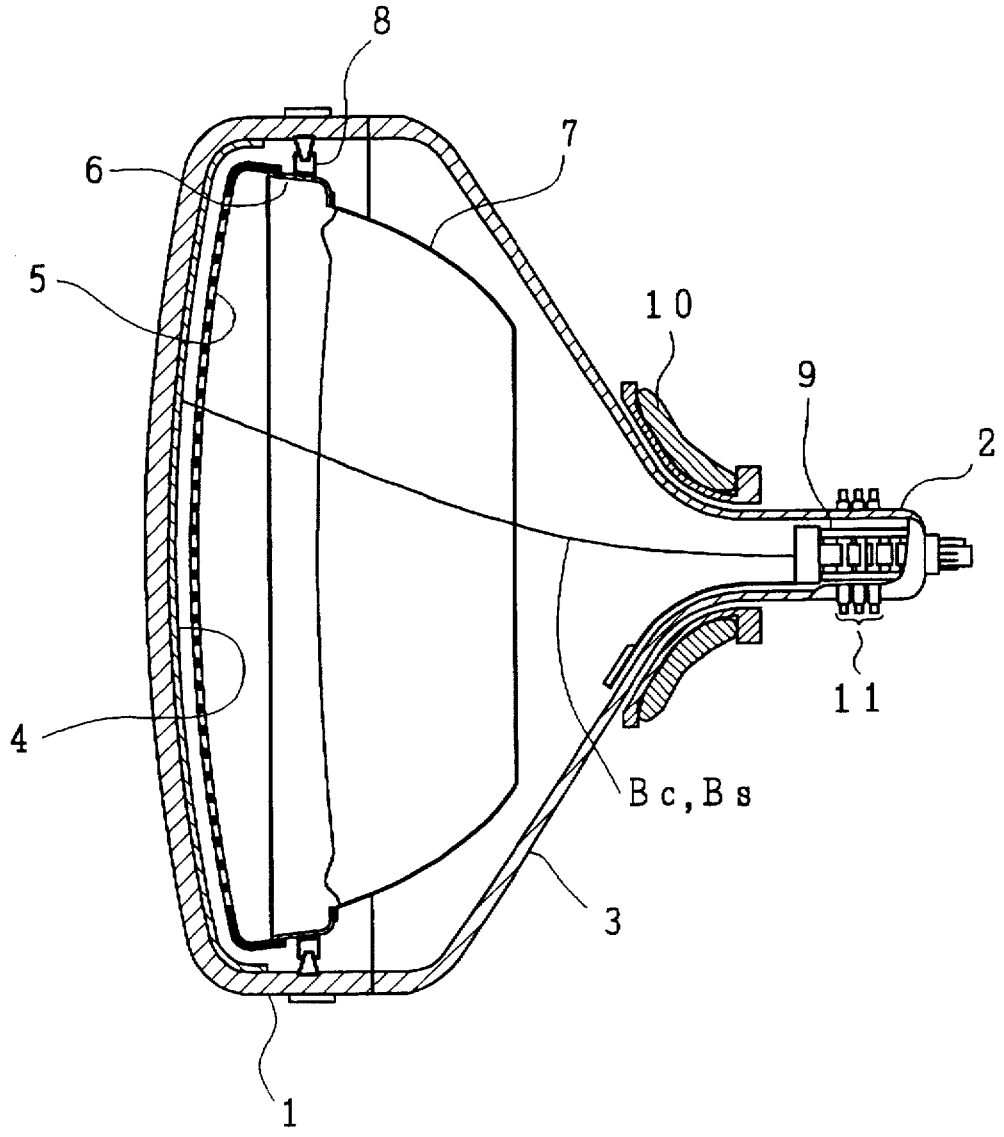
FIG. 9 (PRIOR ART)
FIG. 9 is a sectional view for explaining a construction of a color cathode ray tube of a shadow mask type as an example of the cathode ray tube.

FIG. 8 is a sectional view of the main portion of an electron gun for explaining a sixth embodiment of the cathode ray tube according to the invention. The correction electrodes 97*a* and 97*b* to be formed in the shield cup 97 of the electron gun employing the focus electrode 95 and the anode electrode 96 having the internal electrodes 95-1 and 96-1 are formed separately from the shield cup 97 and are fixed to the bottom of the shield cup 97 by means of welding or the like.

In a manner similar to the above, the correction electrodes 97*a* and 97*b* in the electron gun described in FIG. 4 can be formed separately from the shield cup 97.

The invention is not limited to the above embodiments and it will be obviously understood that the invention can be applied to the cathode ray tube, color cathode ray tube, or other cathode ray tube employing any electron gun including the shield cup having a single opening in its bottom.

The operation principle of the invention will now be described by using the third embodiment shown in FIGS. 4 and 5 as an example.

Figure 13:
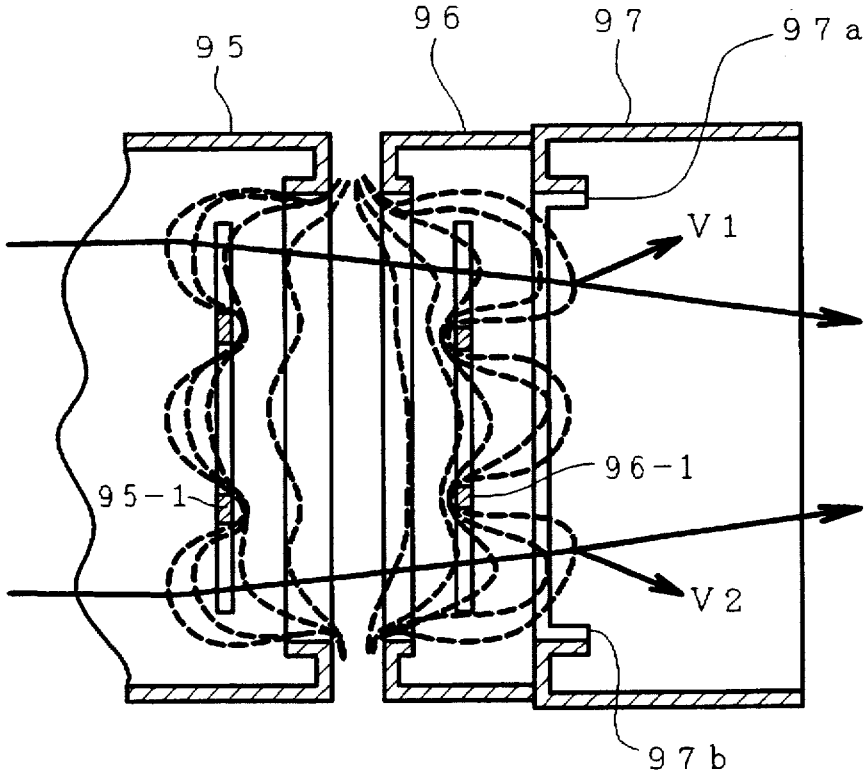
FIG. 13 is a diagram showing equipotential line distributions of the main portion of an electron gun for explaining operation principles of the invention.

In the third embodiment, as shown in FIG. 13, the electric field for the convergence adjustment is produced by the correction electrodes 97*a* and 97*b* extending nearly in parallel with the electron beam traveling direction from both edges in the electron beam inline direction of the single electron beam aperture 97*d* in the bottom on the anode 96 side of the cylinder electrode 97.

Equipotential lines in the vicinity of the path of the side electron beams are bent strongly toward the center electron beam in the outer region remote from the tube axis by the correction electrodes 97*a* and 97*b*. This electric field deflects the side electron beams having been deflected toward the center electron beam in a direction opposite to the center electron beam. That is, the side electron beams receive forces in the directions of v1 and v2 and are deflected away from the center electron beam on the anode electrode side.

It is preferable that the length L lies within a range from 0.5 to 6.0 mm and the height H lies within a range from 3.0 to 12.0 mm in consideration of penetration of the electric field into the anode electrode and mechanical strength of the correction electrode.

According to the invention as mentioned above, there is provided the cathode ray tube provided with an electron gun capable of achieving modification of static convergence in accordance with the change of the screen size or the tube length of a cathode ray tube only by modification of a correction electrode in its extending length and/or its height perpendicular to the inline direction of the electron beams and consequently by reducing influences of the modification on the main lens, enabling application of the main section of the electron gun to a variety of screen sizes of cathode ray tubes in common, providing improved focus over an entire beam current region and excellent resolution.

According to the invention, it is also effective for cost saving by using the main section (triode section and main lens section) of the electron gun in common for various sizes of cathode ray tubes.

What is claimed is:

1. A cathode ray tube including:

an evacuated envelope including a panel portion carrying a phosphor screen, a neck portion housing an electron gun, and a funnel portion for connecting said panel portion and said neck portion;

said electron gun housed in said neck portion for emitting three electron beams arranged in an inline direction; and a deflection device mounted in a transition region between said funnel portion and said neck portion in said evacuated envelope;

wherein said electron gun is provided with an electrode having a single opening common to said three electron beams and having correction electrodes disposed in vicinities of both edges of said single opening which extend substantially transverse to said inline direction of said three electron beams, the electrode having said single opening extending substantially parallel with a cathode ray tube axis into a region downstream of an end surface of an anode electrode forming a main lens on a cathode side thereof and provided with an electric field produced by said main lens, and the electrode having said single opening is electrically connected to said anode electrode, said correction electrodes having tips thereof disposed so as to not extend in a direction towards the cathode ray tube axis beyond a plane which contains the cathode ray tube axis and which extends perpendicular to the inline direction of the three electron beams.

2. A cathode ray tube according to claim 1, wherein said electron gun includes a cylindrical focus electrode having a single opening for passing said three electron beams in one end facing a cylindrical anode electrode and a plate-shaped internal electrode disposed at a position therein set back from said single opening thereof, and said cylindrical anode electrode having a single opening for passing three electron beams in one end thereof facing said cylindrical focus electrode and a plate-shaped internal electrode disposed at a position therein set back from said single opening thereof.

3. A cathode ray tube according to claim 2, wherein said correction electrodes are drawn integrally from a bottom portion of said cylinder electrode.

4. A cathode ray tube according to claim 2, wherein said correction electrodes are extended toward said phosphor screen.

5. A cathode ray tube according to claim 1, wherein said electron gun includes a cylindrical focus electrode having three inline electron beam apertures for respectively passing said three electron beams in an end portion thereof facing an anode electrode, and said anode electrode having three inline electron beam apertures for respectively passing said three electron beams in an end thereof facing said focus electrode and a single opening for passing said three electron beams in the other end thereof, and a cylinder electrode having a single opening for passing said three electron beams and electrically connected to other end of said anode electrode.

6. A cathode ray tube according to claim 5, wherein the anode electrode is a cylindrical anode electrode.

7. A cathode ray tube according to claim 1, wherein said correction electrodes are disposed only in the vicinities of both edges of said single opening which extend substantially transverse to said inline direction of said three electron beams.

8. A cathode ray tube including:

an evacuated envelope including a panel portion carrying a phosphor screen, a neck portion housing an electron gun, and a funnel portion for connecting said panel portion and said neck portion;

said electron gun housed in said neck portion for emitting three electron beams arranged in an inline direction; and a deflection device mounted in a transition region between said funnel portion and said neck portion in said evacuated envelope;

wherein said electron gun has:

a main lens including a cylindrical focus electrode having three inline electron beam apertures for respectively passing said three electron beams in an end portion thereof facing a cylindrical anode electrode, and said cylindrical anode electrode having three inline electron beam apertures for respectively passing said three electron beams in an end thereof facing said focus electrode and a single electron beam opening for passing said three electron beams in the other end thereof;

a cylinder electrode having a single electron beam opening for passing said three electron beams and electrically connected to said other end of said cylindrical anode electrode; and correction electrodes extending nearly in parallel with a passing direction of said three electron beams and disposed at both edges in said inline direction of said single electron beam opening in a bottom portion of said cylinder electrode on said cylindrical anode side of said cylinder electrode, said correction electrodes having tips thereof disposed so as to not extend in a direction towards the cathode ray tube axis beyond a plane which contains the cathode ray tube axis and which extends perpendicular to the inline direction of the three electron beams.

9. A cathode ray tube according to claim 2, wherein said correction electrodes are drawn integrally from said bottom portion of said cylinder electrode.

10. A cathode ray tube according to claim 2, wherein said correction electrodes are constructed by electrode members fixed on said bottom of said cylinder electrode.

11. A cathode ray tube according to claim 2, wherein said correction electrodes are extended toward said phosphor screen.

12. A cathode ray tube according to claim 2, wherein said correction electrodes are extended toward said focus electrode.

13. A cathode ray tube according to claim 9, wherein said correction electrodes are extended toward said phosphor screen.

14. A cathode ray tube according to claim 9, wherein said correction electrodes are extended towards said focus electrode.

15. A cathode ray tube according to claim 10, wherein said correction electrodes are extended toward said phosphor screen.

16. A cathode ray tube according to claim 10, wherein said correction electrodes are extended toward said focus electrode.

17. A cathode ray tube according to claim 8, wherein said correction electrodes are disposed only in the vicinities of both edges of said single opening which extend substantially transverse to said inline direction of said three electron beams.

18. A cathode ray tube including:

an evacuated envelope including a panel portion carrying a phosphor screen, a neck portion housing an electron gun, and a funnel portion for connecting said panel portion and said neck portion;

said electron gun housed in said neck portion for emitting three electron beams arranged in an inline direction; and a deflection device mounted in a transition region between said funnel portion and said neck portion in said evacuated envelope, wherein said electron gun has:

a main lens including a cylindrical focus electrode having a single opening for passing said three electron beams in one end facing a cylindrical anode electrode and a plate-shaped internal electrode disposed at a position therein set back from said single opening thereof, and said cylindrical anode electrode having a single opening for passing said three electron beams in one end thereof facing said cylindrical focus electrode and a plate-shaped internal electrode disposed at a position therein set back from said single opening thereof;

a cylinder electrode having a single electron beam opening electrically connected to said other end of said cylindrical anode electrode for passing said three electron beams; and correction electrodes extending nearly in parallel with a passing direction of said three electron beams and disposed at both edges in said inline direction of said single electron beam opening in a bottom portion of said cylinder electrode on said cylindrical anode side of said cylinder electrode, said correction electrodes having tips thereof disposed so as to not extend in a direction towards the cathode ray tube axis beyond a plane which contains the cathode ray tube axis and which extends perpendicular to the inline direction of the three electron beams.

19. A cathode ray tube according to claim 18, wherein said correction electrodes are drawn integrally from said bottom portion of said cylinder electrode.

20. A cathode ray tube according to claims 18, wherein said correction electrodes are constructed by electrode members fixed to said bottom portion of said cylinder electrode.

21. A cathode ray tube according to claim 18, wherein said correction electrodes are extended toward said phosphor screen.

22. A cathode ray tube according to claim 18, wherein said correction electrodes are extended toward said focus electrode.

23. A cathode ray tube according to claim 18, wherein said correction electrodes are disposed only in the vicinities of both edges of said single opening which extend substantially transverse to said inline direction of said three electron beams.

* * * * *